US008753113B2

(12) United States Patent
Lee et al.

(10) Patent No.: US 8,753,113 B2
(45) Date of Patent: Jun. 17, 2014

(54) REMOVABLE RODENT INTRAORAL DEVICE

(75) Inventors: Heeje Lee, Coppell, TX (US); Alika Yu, Metairie, LA (US); Paul Fidel, Mandeville, LA (US)

(73) Assignee: Board of Supervisors of Louisiana State University And Agricultural and Mechanical College, Baton Rouge, LA (US)

( * ) Notice: Subject to any disclaimer, the term of this patent is extended or adjusted under 35 U.S.C. 154(b) by 353 days.

(21) Appl. No.: 13/111,354

(22) Filed: May 19, 2011

(65) Prior Publication Data

US 2012/0129116 A1 May 24, 2012

Related U.S. Application Data

(60) Provisional application No. 61/348,816, filed on May 27, 2010.

(51) Int. Cl.
*A61D 5/00* (2006.01)

(52) U.S. Cl.
USPC ..... 433/1

(58) Field of Classification Search
USPC ..... 433/1; 119/850; 435/283.1
See application file for complete search history.

(56) References Cited

FOREIGN PATENT DOCUMENTS

FR 2575919 A1 * 7/1986

OTHER PUBLICATIONS

"Magnet as a Dental Material—An Overview" by Ashok Kumar Jena, Ritu Duggal and Puneet Batra—Published at Trends Biomater Artif Organs, vol. 16 (2), pp. 73-80 (2003)—www.sbaoi.org.*
Barclay, S.C. et al., "The effect of chairside relining materials on rat palatal mucosa," J Dent, vol. 25, pp. 251-255 (1997).
Barclay, S.C. et al., "The effect of diet on palatal prosthetic coverage in rats," J Dent, vol. 25, pp. 71-78 (1997).
Imai, Y. et al., "A histomorphometric analysis on bone dynamics in denture supporting tissue under continuous pressure," J Oral Rehabil, vol. 29, pp. 72-79 (2002).
Lee, H. et al.,"Establishment of a Contemporary Rat Model of *Candida*-Associated Denture Stomatitis to Evaluate the Role of Biofilm in Disease," Abstract, 10th ASM Conference on *Candida* and Candidiasis; 2nd ASM Conference on Dimorphic Fungal Pathogens, Miami, FL (Mar. 22-26, 2010).
Lee, H. et al., "Fabrication of a multi-applicable removable intraoral denture system for rodent research," J. Oral Rehab. (e-pub online ahead of print, Feb. 17, 2011).
Mori, S. et al., "Effect of continuous pressure on histopathological changes in denture-supporting tissues," J Oral Rehabil, vol. 24, pp. 37-46 (1997).
Nett, J. et al., "Development and Validation of an In Vivo *Candida albicans* Biofilm Denture Model," Infection and Immunity, vol. 78, pp. 3650-3659 (2010).
Tsuruoka, M. et al., "Morphological and molecular changes in denture-supporting tissues under persistent mechanical stress in rats," J Oral Rehabil, vol. 35, pp. 889-897 (2008).

* cited by examiner

*Primary Examiner* — Cris L Rodriguez
*Assistant Examiner* — Mirayda A Aponte
(74) *Attorney, Agent, or Firm* — John H. Runnels

(57) ABSTRACT

A removable intraoral device is useful for longitudinal in vivo biofilm research. The device is adapted to allow it to be retained in the oral cavity long enough for biofilm to form and to affect the oral mucosa. The device is readily removable to facilitate longitudinal observations. The device is biostable. The device does not interfere with the animal's daily activities such as eating and drinking. The device can be fabricated and maintained at low cost.

2 Claims, 3 Drawing Sheets

REMOVABLE RODENT INTRAORAL DEVICE

The development of this invention was partially funded by the Government under grant 3P20RR020160-05S1 awarded by the National Institutes of Health. The Government has certain rights in this invention.

The benefit of the May 27, 2010 filing date of U.S. provisional patent application Ser. No. 61/348,816 is claimed under 35 U.S.C. §119(e). The entire disclosure of the provisional application is incorporated by reference.

This invention pertains to a convenient, removable intraoral device for use in rodents. It is useful, for example, in studies of materials that are used in prosthodontic devices, in studies of the biofilms that adhere to such devices, and in methods for treating oral diseases related to those biofilms.

A "biofilm" is a community of microbial cells that are attached to a substrate, to an interface, or to each other, in which the cells are embedded in a matrix of extracellular polymers secreted by the cells themselves. In the oral cavity, biofilms play a major role in several infectious diseases, including dental caries, periodontitis, and prosthesis-associated infections such as denture stomatitis. Denture stomatitis is a common oral mucosal disease that is associated with *Candida albicans*, appearing in 27-50% of denture-wearers. Biofilms can cause persistent infections that are often resistant to conventional antimicrobial agents. Further studies of *Candida* biofilms could yield significant improvements in the prevention and treatment of denture stomatitis. There is an unfilled need for improved animal models to study biofilms in the oral cavity, particularly biofilms that form upon or in association with prosthodontic devices.

A convenient intraoral device that is adapted for use in an animal model would be highly useful to researchers studying biofilms, such as *Candida* biofilms. Such a device could allow researchers to better observe the pathogenesis of infection, interactions between the biofilm and the prosthesis, and interactions between the biofilm and host responses (e.g., from oral mucosa). These interactions are simulated poorly by in vitro models. There is an unfilled need for an intraoral device with the following characteristics: 1) The device should be adapted to be retained in the oral cavity long enough for a biofilm to form and to affect the oral mucosa. 2) The device should be readily removable to facilitate longitudinal observations. 3) The device should be biostable. 4) The device should not interfere with the animal's daily activities such as eating and drinking. 5) The device should be easy to fabricate at low cost. To our knowledge, there is no previously reported device that satisfies all these criteria.

Some intraoral devices have previously been reported for rats, but they have been used for other purposes, and none not satisfied all the criteria listed. For example, there have been some prior devices permanently affixed within the oral cavity, while there have been others requiring complicated fabrication processes such as metal casting. See, e.g.: Barclay S C, MacDonald D G, Watson I B. The effect of diet on palatal prosthetic coverage in rats. *J Dent* 1997; 25:71-8. Barclay S C, MacDonald D G, Watson I B. The effect of chairside relining materials on rat palatal mucosa. *J Dent* 1997; 25:251-5. Mori S, Sato T, Nara T, Nakashima K, Minagi S. Effect of continuous pressure on histopathological changes in denture-supporting tissues. *J Oral Rehabil* 1997; 24:37-46. Imai Y, Sato T, Mori S, Okamoto M. A histomorphometric analysis on bone dynamics in denture supporting tissue under continuous pressure. *J Oral Rehabil* 2002; 29:72-9. Tsuruoka M, Ishizaki K, Sakurai K, Matsuzaka K, Inoue T. Morphological and molecular changes in denture-supporting tissues under persistent mechanical stress in rats. *J Oral Rehabil* 2008; 35:889-97. J. Nett et al. Development and Validation of an In Vivo *Candida albicans* Biofilm Denture Model. *Infection and Immunity* 2010; 78:3650-3659.

There is an unfilled need for a removable intraoral device for rodents, particularly rats. The usual mechanisms for retaining removable prostheses in the human oral cavity do not work well in rodents, due to the very different morphologies of the oral cavity, jaws, and teeth. A rat will not voluntarily tolerate a foreign object in its mouth. The size of the rat's oral cavity is too small to use conventional clasps or attachments for intraoral devices such as might be used in humans. The jaw bone is too thin to anchor a dental implant in the bone. In larger animals, dental devices that are more similar to those used for humans could perhaps be effective, but the cost of research generally increases substantially for larger animals.

We have discovered a novel, removable intraoral device for use in rodents that is adapted to be retained in the oral cavity long enough for a biofilm to form and to affect the oral mucosa. The novel device is readily removable to facilitate longitudinal observations. The novel device is biostable. The novel device does not interfere with the animal's daily activities such as eating and drinking. The novel device can be fabricated and maintained at low cost. The novel device is useful for prosthodontic studies generally, and in particular it is well-suited for biofilm research.

The novel device may be used for research into many areas involving prosthodontic materials, biofilms, or prosthetic-associated infectious diseases. Examples include the pathogenesis and treatment of denture stomatitis, the testing of antimicrobial denture materials, the testing of drug delivery systems, and so forth.

The novel device contains a fixed part, anchored by orthodontic wire between the rodent's teeth, for example with acrylic resin; and a removable part, which may adhere to the fixed part with magnets. The device is small, simple, and inexpensive. The removable part may be removed and replaced with ease, not requiring any special tools. The anterior portion of the palate is accessible for studying the interaction between the removable part and the oral mucosa. The posterior portion of the palate is covered by the fixed part of the device. Corrosion of the magnets was a concern in an early prototype, but we found that coating the magnets, for example with a gypsum hardener, protected the magnets from corrosion for at least two months and likely longer. Even with the earlier, non-gypsum hardener-coated prototype, the minor corrosion did not appear to affect retention of the removable part, nor to affect adjacent soft tissue. The device did not appear to interfere with the rat's normal daily activities, such as eating and drinking. Nor did it appear to affect the rats' body mass.

The novel device is durable. All devices tested to date have remained in place in the rats' mouths for at least two months, a sufficient time for disease to development and for the study of biofilms. We have tested over 50 of the novel devices. In a few instances, after times longer than two months, the fixed part has loosened as the acrylic resin on the occlusal surface eroded due to constant wear from the opposing teeth. However, those devices were easily repaired by adding new acrylic resin to the broken area under anesthesia. It was not necessary to remove the old acrylic; the new acrylic was simply added atop the old.

DESCRIPTION OF PROTOTYPE DEVICE AND METHOD OF FABRICATION AND INSTALLATION

Figure 1:
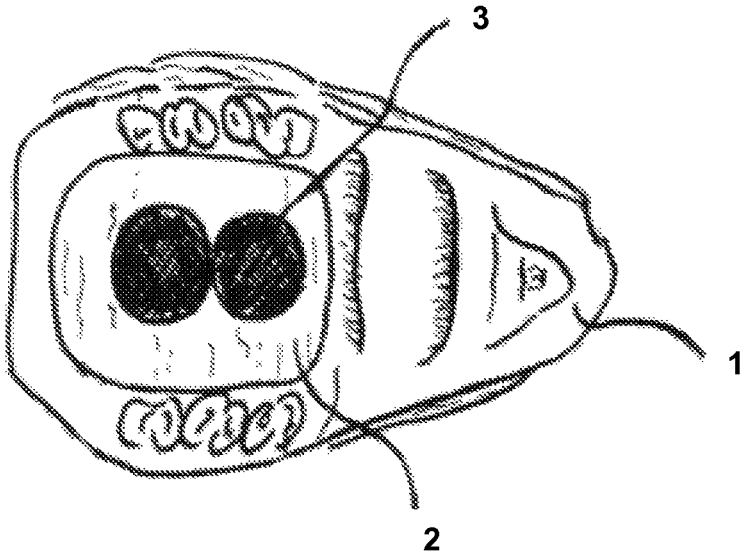
FIG. 1 depicts schematically one embodiment of the fixed part of the novel device.
Figure 2:
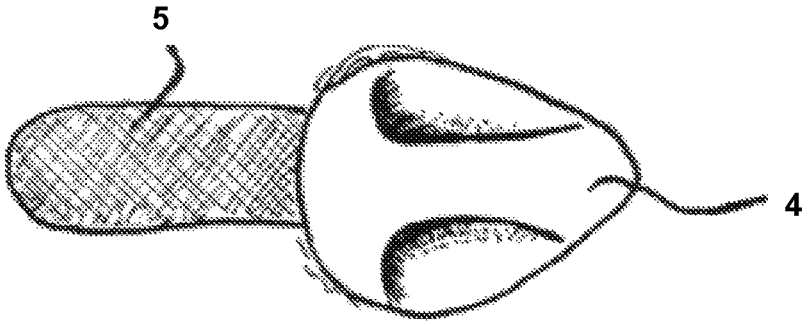
FIG. 2 depicts schematically one embodiment of the removable part of the novel device.
Figure 3:
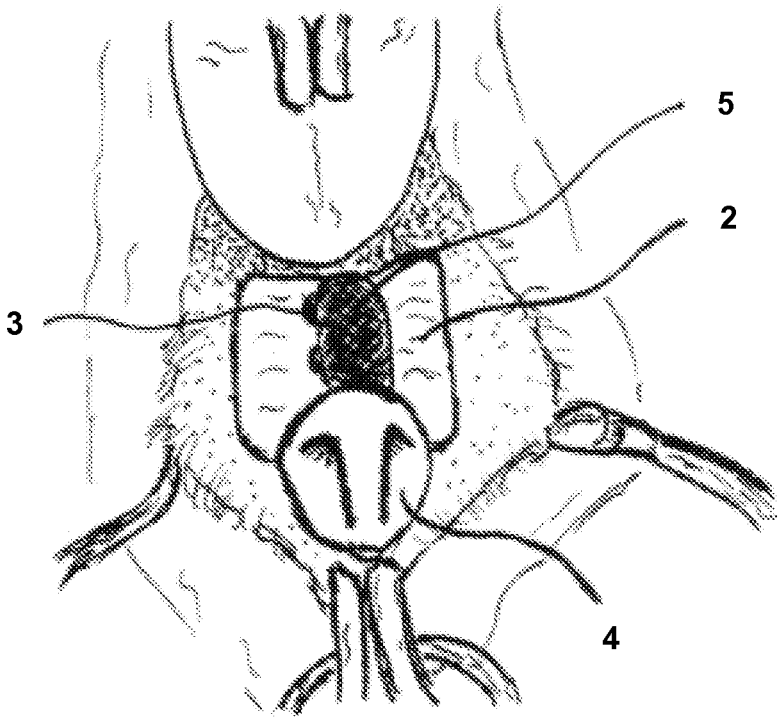
FIG. 3 depicts schematically one embodiment of the novel device positioned within a rat's mouth.

FIGS. 1-3 depict schematically a prototype device that has been constructed in accordance with the present invention. FIG. 1 depicts a cast model 1 of a rats maxilla, the fixed portion 2 of the novel device, containing two discs 3. FIG. 2 depicts the removable portion 4 of the device, containing metal bar 5. The discs 3 comprise a permanent ferromagnet or a ferromagnetic material. The metal bar 5 comprises a permanent ferromagnet or a ferromagnetic material. At least one of the discs 3 or the metal bar 5 comprises a permanent ferromagnet. FIG. 3 depicts an intraoral view of the prototype device in rat's mouth, showing both the fixed portion 2 and the removable portion 4.

(1) Male Wistar rats (retired breeders) were used in fabricating and installing prototype devices in accordance with the present invention. (2) Each rat was weighed, and anesthesia was administered in accordance with standard protocols. (3) The rat was placed in a supine position, and the mouth was opened.

(4) A piece 5 mm wide by 50 mm long was cut from a wooden tongue depressor. One end of the cut wood was coated on both sides with a vinyl polysiloxane (VPS) adhesive (Tray Adhesive; Dentsply Caulk, Milford, Del.), which was then air-dried. (5) A light-body VPS impression material (Aquasil Ultra LV; Dentsply Caulk) was injected directly onto the palate and onto all maxillary cheek teeth using a manual, gun-type dispenser (Cartridge Dispensing Gun; Dentsply Caulk), an auto mix tip (Mix Tips; Dentsply Caulk), and an intraoral tip (Intra-Oral Tips; Dentsply Caulk). The adhesive-coated end of the cut wood was gently placed on top of the impression material immediately after the first injection, and the end of the tongue depressor was then covered with a second injection of VPS. The VPS was then allowed to polymerize in place.

(6) The impression was then gently removed from the rat's mouth, and used to form a counterpart in type III dental stone (Quickstone; Whip Mix Corp, Louisville, Ky.). After setting, the stone cast was separated from the impression and trimmed. (7) An acrylic separating agent (Al-Cote Separating Agent; Dentsply Caulk) was coated onto the cast surface. A 2 mm wax dam (Sculpturing Wax Blue Transparent; Renfert GmbH, Hilzingen, Germany) was formed across the mesial aspects of the maxillary right and left first cheek teeth, in order to separate the area for the fixed part from that for the removable part.

(8) A stainless steel surgical blade (No. 25; Miltex, Inc, York, Pa.) was cut into a metal bar 3 mm wide and 12 mm long, with two notches at one end. The steel blade was cut with a carborundum separating disc (Ultraflex; Keystone Industries, Cherry Hill, N.J.). (9) Two magnets (D21B-N52, Nd—Fe—B, disk shape, diameter ⅛ inch, thickness 1/16 inch; K&J Magnetics, Inc, Jamison, Pa.) were coated with a gypsum surface hardener to inhibit corrosion. The two magnets were positioned in the middle of the cast stone palate, and the metal bar was attached to the magnets. The bar was temporarily attached to the cast with wax.

(10) A thin mix of autopolymerizing acrylic resin (Jet Tooth Shade Acrylic; Lang Dental, Wheeling, Ill.) was poured onto the cast to cover the palate and the magnets, but not the metal bar. After the polymer had cured, the metal bar was detached from the magnets, and the wax was cleaned both from the cast and from the metal bar. The bar was then replaced in the same position on the magnets.

(11) Another batch of the autopolymerizing acrylic resin was prepared and applied to cover the notch side of the metal bar, without reaching the fixed portion. After polymerization, both the fixed and removable parts were removed (12) Using an acrylic bur (Long Cross Cut Fissure; Brasseler USA, Savannah, Ga.), notches were cut on both the left and right sides of the removable part. The fixed and removable parts were trimmed.

(13) An orthodontic ligature wire (Item number 4920-110, 0.25 mm diameter; Masel, Bristol, Pa.) was cut into 2 pieces, each piece 15 mm long. A loop was formed on one end of each of the pieces of wire, so that the overall length of each piece was 7 mm. By using this loop configuration, one may save considerable time over an alternative procedure such as tying a knot. (The use of an orthodontic wire loop in prosthodontic devices is not a standard practice.)

Figure 4:
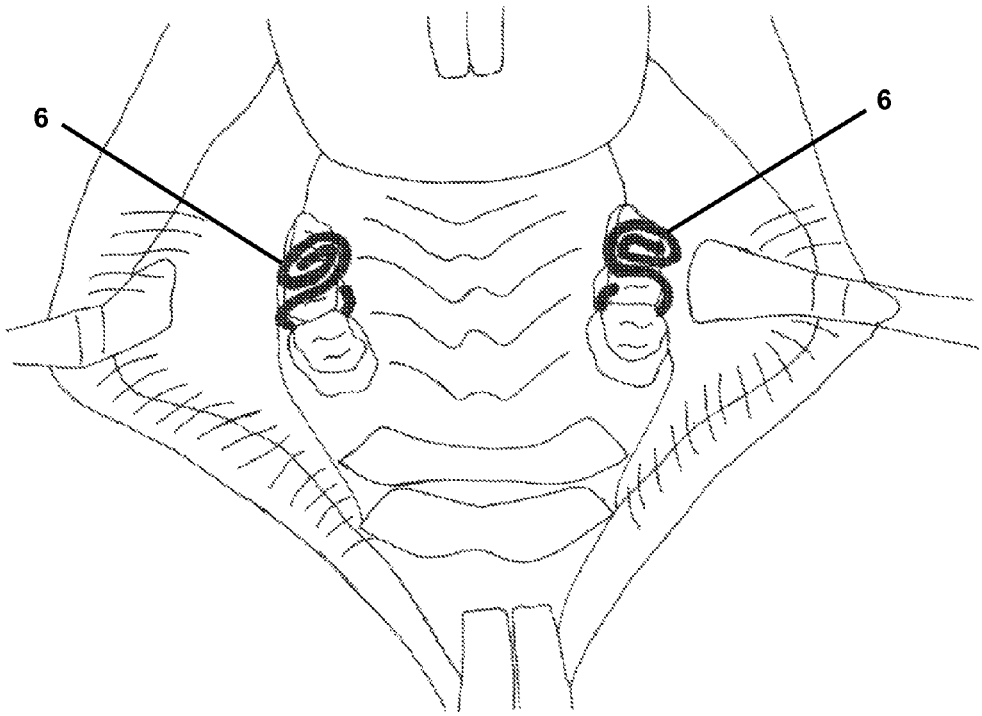
FIG. 4 depicts schematically one embodiment of orthodontic ligature wires used to attach the fixed portion of the device to the rodent's upper cheek teeth, wherein each wire is shaped into a loop on one end.

(14) The rat was again anesthetized and placed in a supine position with the mouth open. Referring to FIG. 4, orthodontic ligature wires 6 were inserted from the buccal side in both the right and left interproximal spaces, between the first and second cheek teeth. The extruded orthodontic ligature wires 6 were bent from the palatal side over the occlusal surface, into loops for fixed attachment to the rodent's upper cheek teeth. (15) The assembly of fixed and removable parts was placed in the rat's mouth and the fit was checked. Using a "salt-and-pepper" technique, small increments of the autopolymerizing acrylic resin were applied to the cheek teeth with a dental brush (Red Sable Brush, #2; Keystone Dental, Inc, Burlington, Mass.), to bond the cheek teeth to the fixed part of the device. Care was taken to cover the wire and all occlusal surfaces with the acrylic resin. The acrylic resin was not allowed to contact the removable part. (16) After the acrylic resin had polymerized, we checked the security of the fixed part, and we checked the removability of the removable part.

Preliminary Results. A removable intraoral device as described above was installed into the mouth of each of a group of rats under anesthesia. The rats were weaned from a pellet diet to a gel diet to keep food debris from collecting between the denture and the palate. *Candida* was then inoculated as a paste onto the palate of anesthetized rats. After 28 days, scanning electron microscopy (SEM) showed biofilm formation on the device, but not yet on the palate. After 42 days, SEM showed biofilm formation on both the device and the palate. After 42 days, clinical manifestations of biofilm-related infection were observed on the palate, including pinpoint hyperemia, diffuse erythema, and papillary hyperplasia. A control rat that was not fitted with the device, but that had been inoculated with *Candida* onto the palate, showed no signs of biofilm-related infection, either clinically or microscopically. Likewise, a rat with a denture installed, but without inoculation, had no evidence of *Candida* colonization on either the palate or the denture, and showed no signs of disease.

The complete disclosures of all references cited in this specification are hereby incorporated by reference, as is the complete disclosure of the priority application Ser. No. 61/348,816, filed May 27, 2010. Also incorporated by reference is the complete disclosure of the following publications by the inventors and colleagues: H. Lee et al. Fabrication of a multi-applicable removable intraoral denture system for rodent research. *J. Oral Rehab*. (e-pub online ahead of print, Feb. 17, 2011); H. Lee et al., "Establishment of a Contemporary Rat Model of *Candida*-Associated Denture Stomatitis to Evaluate the Role of Biofilm in Disease," Abstract, 10th ASM Conference on *Candida* and Candidiasis; 2nd ASM Conference on Dimorphic Fungal Pathogens, Miami, Fla. (Mar. 22-26, 2010). In the event of an otherwise irreconcilable conflict, however, the present specification shall control.

What is claimed:

1. An intraoral device for a rodent; said device comprising a fixed portion and a removable portion; wherein:

(a) said fixed portion has a shape that is complementary to the rodent's anterior palate, and said fixed portion is held in place adjacent the posterior palate by fixed attachment to the rodent's upper cheek teeth;

(b) said removable portion is magnetically held in place adjacent said fixed portion; and at least a portion of the surface of said removable portion comprises a prosthodontic material, wherein a surface of the prosthodontic material contacts the rodent's intraoral tissue;

(c) said fixed portion comprises a permanent ferromagnet or a ferromagnetic material; and said removable portion comprises a permanent ferromagnet or a ferromagnetic material; wherein at least one of said fixed portion and said removable portion comprises a permanent ferromagnet; wherein said fixed and removable portions will magnetically attract one another with sufficient force to hold said removable portion in place, adjacent said fixed portion within the rodent's mouth, for an extended period of time without being dislodged by the normal activities of the rodent; but wherein said removable device may easily be removed from the rodent's mouth by a human when desired, by applying a mechanical force to the removable portion sufficient to overcome the magnetic force between said fixed and removable portions.

2. A device as in claim 1, wherein said fixed portion is held in place by fixed attachment to the rodent's upper cheek teeth with one or more orthodontic ligature wires, wherein each said wire is shaped into a loop on one end.

* * * * *